US008130966B2

(12) United States Patent
Grimani

(10) Patent No.: US 8,130,966 B2
(45) Date of Patent: Mar. 6, 2012

(54) METHOD FOR PERFORMANCE MEASUREMENT AND OPTIMIZATION OF SOUND SYSTEMS USING A SLIDING BAND INTEGRATION CURVE

(76) Inventor: Anthony Grimani, Fairfax, CA (US)

( * ) Notice: Subject to any disclaimer, the term of this patent is extended or adjusted under 35 U.S.C. 154(b) by 484 days.

(21) Appl. No.: 12/447,651

(22) PCT Filed: Oct. 31, 2007

(86) PCT No.: PCT/US2007/083243

§ 371 (c)(1),
(2), (4) Date: Apr. 28, 2009

(87) PCT Pub. No.: WO2008/055238

PCT Pub. Date: May 8, 2008

(65) Prior Publication Data

US 2010/0061561 A1 Mar. 11, 2010

Related U.S. Application Data

(60) Provisional application No. 60/863,751, filed on Oct. 31, 2006.

(51) Int. Cl.
*H04R 5/00* (2006.01)
*H04R 1/40* (2006.01)

(52) U.S. Cl. ..... 381/17; 381/59; 381/86; 381/92; 381/97; 381/99; 381/104; 381/300; 381/303

(58) Field of Classification Search ..... 381/17, 381/59, 86, 92, 97, 99, 104, 300, 303
See application file for complete search history.

(56) References Cited

U.S. PATENT DOCUMENTS

| | | | | |
|---|---|---|---|---|
| 4,764,960 | A | 8/1988 | Aoki et al. | |
| 5,386,478 | A | 1/1995 | Plunkett | |
| 5,465,302 | A | 11/1995 | Lazzari et al. | |
| 5,778,087 | A | 7/1998 | Dunlavy | |
| 6,118,880 | A | 9/2000 | Kokkosoulis et al. | |
| 7,184,556 | B1 * | 2/2007 | Johnson et al. | 381/61 |
| 7,593,533 | B2 * | 9/2009 | Fincham | 381/17 |
| 2006/0002571 | A1 | 1/2006 | Holloway et al. | |
| 2008/0130904 | A1 * | 6/2008 | Faller | 381/17 |
| 2009/0003613 | A1 * | 1/2009 | Christensen | 381/58 |
| 2010/0290643 | A1 * | 11/2010 | Mihelich et al. | 381/99 |

* cited by examiner

*Primary Examiner* — Dao H Nguyen
(74) *Attorney, Agent, or Firm* — Craig M. Stainbrook; Stainbrook & Stainbrook, LLP

(57) ABSTRACT

A method for performance measurement and optimization of sound systems using electroacoustic measurements and a sliding band integration curve. Nearfield and spatially and temporally averaged broadband farfield responses are measured, averaged over a distinct set of frequencies, level matched, and weighted using a frequency-dependent ratio. The two curves are then combined to produce a third curve. The results indicate system performance in a listening space that matches human sensory response and provides means to optimize the sound system for the listening space.

24 Claims, 4 Drawing Sheets

SBIC Calculations

| Frequency (Hz) (110) | Log of Frequency (120) | Weighting (%) (310) | No EQ (130): Nearfield Level Compensated (160) | No EQ: Farfield (140) | No EQ: Combined (320) | EQ (135): Nearfield Level Compensated (160) | EQ: Farfield (140) | EQ: Combined (320) |
|---|---|---|---|---|---|---|---|---|
| 20 | 1.30103 | 20 | | | | | | |
| 25 | 1.39794 | 20 | 35.81027 | 56.03906 | 51.993304 | 37.41035 | 51.27344 | 48.500820 |
| 31 | 1.49136 | 20 | 34.16964 | 50.15625 | 46.958929 | 37.04316 | 45.40625 | 43.733633 |
| 40 | 1.60206 | 20 | 44.67746 | 51.46875 | 50.110491 | 45.33223 | 49.84375 | 48.941445 |
| 50 | 1.69897 | 20 | 49.04464 | 54.51563 | 53.421429 | 48.01973 | 54.36719 | 53.097695 |
| 63 | 1.79934 | 20 | 50.69308 | 54.55469 | 53.782366 | 50.13691 | 53.18750 | 52.577383 |
| 80 | 1.90309 | 20 | 60.09152 | 62.40625 | 61.943304 | 57.33223 | 59.08400 | 58.733645 |
| 100 | 2 | 20 | 63.08371 | 65.92188 | 65.354241 | 58.76973 | 59.89400 | 59.669145 |
| 125 | 2.09691 | 20 | 65.20871 | 64.99219 | 65.035491 | 59.92598 | 58.92200 | 59.122795 |
| 160 | 2.20412 | 20 | 62.95871 | 58.19531 | 59.147991 | 60.35566 | 57.76500 | 58.283133 |
| 200 | 2.30103 | 28.57143 | 59.34152 | 54.86719 | 56.145568 | 59.80879 | 56.45313 | 57.411886 |
| 250 | 2.39794 | 37.14286 | 60.78683 | 56.69531 | 58.215019 | 59.05879 | 58.37500 | 58.628978 |
| 315 | 2.49831 | 45.71429 | 59.83371 | 60.17188 | 60.017283 | 57.67598 | 59.08594 | 58.441383 |
| 400 | 2.60206 | 54.28571 | 61.56808 | 63.50000 | 62.451244 | 58.41035 | 61.29688 | 59.729904 |
| 500 | 2.69897 | 62.85714 | 61.38839 | 57.05469 | 59.778731 | 59.73066 | 56.60156 | 58.568425 |
| 630 | 2.79934 | 71.42857 | 56.05246 | 58.75781 | 56.825415 | 55.66035 | 59.32813 | 56.708286 |
| 800 | 2.90309 | 80 | 55.79464 | 55.57031 | 55.749777 | 57.71504 | 57.15625 | 57.603280 |
| 1000 | 3 | 80 | 59.98996 | 58.76563 | 59.745089 | 59.60566 | 59.73438 | 59.631405 |
| 1250 | 3.09691 | 80 | 58.23996 | 58.53125 | 58.298214 | 57.01973 | 58.61717 | 57.339218 |
| 1600 | 3.20412 | 80 | 59.38058 | 59.80469 | 59.465402 | 58.16035 | 59.59375 | 58.447030 |
| 2000 | 3.30103 | 80 | 59.61496 | 61.97656 | 60.087277 | 59.55879 | 61.92188 | 60.031405 |
| 2500 | 3.39794 | 80 | 60.68527 | 60.57813 | 60.663839 | 59.62129 | 60.74219 | 59.845468 |
| 3150 | 3.49831 | 80 | 61.38839 | 61.50000 | 61.410714 | 59.30098 | 60.87500 | 59.615780 |
| 4000 | 3.60206 | 80 | 58.79464 | 59.15625 | 58.866964 | 58.51191 | 59.39063 | 58.687655 |
| 5000 | 3.69897 | 80 | 58.52121 | 60.54688 | 58.926339 | 58.55879 | 60.66406 | 58.979843 |
| 6300 | 3.79934 | 80 | 58.34152 | 57.79688 | 58.232589 | 57.86348 | 57.76563 | 57.843905 |
| 8000 | 3.90309 | 80 | 57.82589 | 57.09375 | 57.679464 | 57.34004 | 57.10938 | 57.293905 |
| 10000 | 4 | 80 | 56.58371 | 56.52344 | 56.571652 | 56.88691 | 56.55469 | 56.820468 |
| 12500 | 4.09691 | 80 | 57.26339 | 55.95313 | 57.001339 | 57.21504 | 56.17188 | 57.006405 |
| 16000 | 4.20412 | 80 | 55.95089 | 54.75781 | 55.712277 | 56.71504 | 54.51563 | 56.275155 |
| 20000 | 4.30103 | 80 | 48.64621 | 46.57031 | 48.231027 | 52.70723 | 45.89063 | 51.343905 |

100 Data Entry Fields

| 110 Frequency (Hz) | 120 Log of Frequency | 140 | 130 No EQ Farfield | No EQ Nearfield Level Compensated (160) | No EQ Nearfield (150) | 140 EQ Farfield | EQ Nearfield Level Compensated (160) | EQ Nearfield (150) |
|---|---|---|---|---|---|---|---|---|
| 25 | 1.39794001 | 0 | 56.03906 | 35.81027 | 51.63281 | 51.27344 | 37.41035 | 54.12500 |
| 31.5 | 1.49831055 | 0 | 50.15625 | 34.16964 | 49.99219 | 45.40625 | 37.04316 | 53.75781 |
| 40 | 1.60205999 | 0 | 51.46875 | 44.67746 | 60.50000 | 49.84375 | 45.33223 | 62.04688 |
| 50 | 1.69897000 | 0 | 54.51563 | 49.04464 | 64.86719 | 54.36719 | 48.01973 | 64.73438 |
| 63 | 1.79934055 | 0 | 54.55469 | 50.69308 | 66.51563 | 53.18750 | 50.13691 | 66.85156 |
| 80 | 1.90308999 | 0 | 62.40625 | 60.09152 | 75.91406 | 59.08400 | 57.33223 | 74.04688 |
| 100 | 2 | 0 | 65.92188 | 63.08371 | 78.90625 | 59.89400 | 58.76973 | 75.48438 |
| 125 | 2.09691001 | 0 | 64.99219 | 65.20871 | 81.03125 | 58.92200 | 59.92598 | 76.64063 |
| 160 | 2.20411998 | 0 | 58.19531 | 62.95871 | 78.78125 | 57.76500 | 60.35566 | 77.07031 |
| 200 | 2.30103000 | 0 | 54.86719 | 59.34152 | 75.16406 | 56.45313 | 59.80879 | 76.52344 |
| 250 | 2.39794001 | 0 | 56.69531 | 60.78683 | 76.60938 | 58.37500 | 59.05879 | 75.77344 |
| 315 | 2.49831055 | 0 | 60.17188 | 59.83371 | 75.65625 | 59.08594 | 57.67598 | 74.39063 |
| 400 | 2.60205999 | 0 | 63.50000 | 61.56808 | 77.39063 | 61.29688 | 58.41035 | 75.12500 |
| 500 | 2.69897000 | 0 | 57.05469 | 61.38839 | 77.21094 | 56.60156 | 59.73066 | 76.44531 |
| 630 | 2.79934055 | 0 | 58.75781 | 56.05246 | 71.87500 | 59.32813 | 55.66035 | 72.37500 |
| 800 | 2.90308999 | 0 | 55.57031 | 55.79464 | 71.61719 | 57.15625 | 57.71504 | 74.42969 |
| 1000 | 3 | 0 | 58.76563 | 59.98996 | 75.81250 | 59.73438 | 59.60566 | 76.32031 |
| 1250 | 3.09691001 | 0 | 58.53125 | 58.23996 | 74.06250 | 58.61719 | 57.01973 | 73.73438 |
| 1600 | 3.20411998 | 0 | 59.80469 | 59.38058 | 75.20313 | 59.59375 | 58.16035 | 74.87500 |
| 2000 | 3.30103000 | 0 | 61.97656 | 59.61496 | 75.43750 | 61.92188 | 59.55879 | 76.27344 |
| 2500 | 3.39794001 | 0 | 60.57813 | 60.68527 | 76.50781 | 60.74219 | 59.62129 | 76.33594 |
| 3150 | 3.49831055 | 0 | 61.50000 | 61.38839 | 77.21094 | 60.87500 | 59.30098 | 76.01563 |
| 4000 | 3.60205999 | 0 | 59.15625 | 58.79464 | 74.61719 | 59.39063 | 58.51191 | 75.22656 |
| 5000 | 3.69897000 | 0 | 60.54688 | 58.52121 | 74.34375 | 60.66406 | 58.55879 | 75.27344 |
| 6300 | 3.79934055 | 0 | 57.79688 | 58.34152 | 74.16406 | 57.76563 | 57.86348 | 74.57813 |
| 8000 | 3.90308999 | 0 | 57.09375 | 57.82589 | 73.64844 | 57.10938 | 57.34004 | 74.05469 |
| 10000 | 4 | 0 | 56.52344 | 56.58371 | 72.40625 | 56.55469 | 56.88691 | 73.60156 |
| 12500 | 4.09691001 | 0 | 55.95313 | 57.26339 | 73.08594 | 56.17188 | 57.21504 | 73.92969 |
| 16000 | 4.20411998 | 0 | 54.75781 | 55.95089 | 71.77344 | 54.51563 | 56.71504 | 73.42969 |
| 20000 | 4.30103000 | 0 | 46.57031 | 48.64621 | 64.46875 | 45.89063 | 52.70723 | 69.42188 |

| This average is taken from 500 - 2k Hz | Average (170) | Average (180) | Average (170) | Average (180) |
|---|---|---|---|---|
| | 58.63728 dB | 74.45982 dB | 58.14035 dB | 74.85500 dB |
| | dB Compensation 15.82254 (190) | | dB Compensation 16.71465 (190) | |

FIG. 1

| Frequency (Hz) | Log of Frequency | |
|---|---|---|
| 20 | 1.30103000 | 0 |
| 30 | 1.47712125 | 0 |
| 40 | 1.60205999 | 0 |
| 50 | 1.69897000 | 0 |
| 60 | 1.77815125 | 0 |
| 70 | 1.84509804 | 0 |
| 80 | 1.90308999 | 0 |
| 90 | 1.95424251 | 0 |
| 100 | 2 | 0 |
| 200 | 2.30103000 | 0 |
| 300 | 2.47712125 | 0 |
| 400 | 2.60205999 | 0 |
| 500 | 2.69897000 | 0 |
| 600 | 2.77815125 | 0 |
| 700 | 2.84509804 | 0 |
| 800 | 2.90308999 | 0 |
| 900 | 2.95424251 | 0 |
| 1000 | 3 | 0 |
| 2000 | 3.30103000 | 0 |
| 3000 | 3.47712125 | 0 |
| 4000 | 3.60205999 | 0 |
| 5000 | 3.69897000 | 0 |
| 6000 | 3.77815125 | 0 |
| 7000 | 3.84509804 | 0 |
| 8000 | 3.90308999 | 0 |
| 9000 | 3.95424251 | 0 |
| 10000 | 4 | 0 |
| 20000 | 4.30103000 | 0 |

FIG. 3 SBIC Calculations

| Frequency (Hz) (110) | Log of Frequency (120) | Weighting (%) (310) | No EQ (130) Nearfield Level Compensated (160) | No EQ Farfield (140) | No EQ Combined (320) | EQ (135) Nearfield Level Compensated (160) | EQ Farfield (140) | EQ Combined (320) |
|---|---|---|---|---|---|---|---|---|
| 20 | 1.30103 | 20 | | | | | | |
| 25 | 1.39794 | 20 | 35.81027 | 56.03906 | 51.993304 | 37.41035 | 51.27344 | 48.500820 |
| 31 | 1.49136 | 20 | 34.16964 | 50.15625 | 46.958929 | 37.04316 | 45.40625 | 43.733633 |
| 40 | 1.60206 | 20 | 44.67746 | 51.46875 | 50.110491 | 45.33223 | 49.84375 | 48.941445 |
| 50 | 1.69897 | 20 | 49.04464 | 54.51563 | 53.421429 | 48.01973 | 54.36719 | 53.097695 |
| 63 | 1.79934 | 20 | 50.69308 | 54.55469 | 53.782366 | 50.13691 | 53.18750 | 52.577383 |
| 80 | 1.90309 | 20 | 60.09152 | 62.40625 | 61.943304 | 57.33223 | 59.08400 | 58.733645 |
| 100 | 2 | 20 | 63.08371 | 65.92188 | 65.354241 | 58.76973 | 59.89400 | 59.669145 |
| 125 | 2.09691 | 20 | 65.20871 | 64.99219 | 65.035491 | 59.92598 | 58.92200 | 59.122795 |
| 160 | 2.20412 | 20 | 62.95871 | 58.19531 | 59.147991 | 60.35566 | 57.76500 | 58.283133 |
| 200 | 2.30103 | 28.57143 | 59.34152 | 54.86719 | 56.145568 | 59.80879 | 56.45313 | 57.411886 |
| 250 | 2.39794 | 37.14286 | 60.78683 | 56.69531 | 58.215019 | 59.05879 | 58.37500 | 58.628978 |
| 315 | 2.49831 | 45.71429 | 59.83371 | 60.17188 | 60.017283 | 57.67598 | 59.08594 | 58.441383 |
| 400 | 2.60206 | 54.28571 | 61.56808 | 63.50000 | 62.451244 | 58.41035 | 61.29688 | 59.729904 |
| 500 | 2.69897 | 62.85714 | 61.38839 | 57.05469 | 59.778731 | 59.73066 | 56.60156 | 58.568425 |
| 630 | 2.79934 | 71.42857 | 56.05246 | 58.75781 | 56.825415 | 55.66035 | 59.32813 | 56.708286 |
| 800 | 2.90309 | 80 | 55.79464 | 55.57031 | 55.749777 | 57.71504 | 57.15625 | 57.603280 |
| 1000 | 3 | 80 | 59.98996 | 58.76563 | 59.745089 | 59.60566 | 59.73438 | 59.631405 |
| 1250 | 3.09691 | 80 | 58.23996 | 58.53125 | 58.298214 | 57.01973 | 58.61717 | 57.339218 |
| 1600 | 3.20412 | 80 | 59.38058 | 59.80469 | 59.465402 | 58.16035 | 59.59375 | 58.447030 |
| 2000 | 3.30103 | 80 | 59.61496 | 61.97656 | 60.087277 | 59.55879 | 61.92188 | 60.031405 |
| 2500 | 3.39794 | 80 | 60.68527 | 60.57813 | 60.663839 | 59.62129 | 60.74219 | 59.845468 |
| 3150 | 3.49831 | 80 | 61.38839 | 61.50000 | 61.410714 | 59.30098 | 60.87500 | 59.615780 |
| 4000 | 3.60206 | 80 | 58.79464 | 59.15625 | 58.866964 | 58.51191 | 59.39063 | 58.687655 |
| 5000 | 3.69897 | 80 | 58.52121 | 60.54688 | 58.926339 | 58.55879 | 60.66406 | 58.979843 |
| 6300 | 3.79934 | 80 | 58.34152 | 57.79688 | 58.232589 | 57.86348 | 57.76563 | 57.843905 |
| 8000 | 3.90309 | 80 | 57.82589 | 57.09375 | 57.679464 | 57.34004 | 57.10938 | 57.293905 |
| 10000 | 4 | 80 | 56.58371 | 56.52344 | 56.571652 | 56.88691 | 56.55469 | 56.820468 |
| 12500 | 4.09691 | 80 | 57.26339 | 55.95313 | 57.001339 | 57.21504 | 56.17188 | 57.006405 |
| 16000 | 4.20412 | 80 | 55.95089 | 54.75781 | 55.712277 | 56.71504 | 54.51563 | 56.275155 |
| 20000 | 4.30103 | 80 | 48.64621 | 46.57031 | 48.231027 | 52.70723 | 45.89063 | 51.343905 |

METHOD FOR PERFORMANCE MEASUREMENT AND OPTIMIZATION OF SOUND SYSTEMS USING A SLIDING BAND INTEGRATION CURVE

TECHNICAL FIELD

The present invention, which was submitted under 35 U.S.C. 371 based on PCT/US2007/083243, filed Oct. 31, 2007 (Oct. 31, 2007) which, in turn, claims the benefit of U.S. Provisional Patent Application Ser. No. 60/863,751, filed Oct. 31, 2006 (Oct. 31, 2006) and incorporated in its entirety by reference herein, relates generally to methods for improving the quality of sound systems, and more particularly to a system and method for performance measurement and optimization of sound systems using electroacoustic measurements and a sliding band integration curve (SBIC).

BACKGROUND OF THE INVENTION

Background Art

Sound systems traditionally employ one or multiple loudspeakers. Elaborate consumer and commercial systems currently incorporate sophisticated electronics and numerous speakers. In order for the listener to achieve a natural and realistic listening experience, the level of the speakers and the position of the listener must be precisely located. The most acoustically balanced position of the listener in relation to sound emanating from the speakers is often referred to as the "sweet spot."

In an acoustically perfect room, the sweet spot is generally easy to determine; but there are few acoustically perfect rooms. Reflected signals cause frequency collisions, muddy the sound, and add a displeasing complexity to the acoustic picture. Several approaches have been employed to optimize the listening experience. These include level balance and fader controls and graphic equalizers. The basic idea of room equalization is for the sound system to produce in the room exactly the same signal which is put into the system. So if pink noise is introduced into a system and pink noise is the output, you are close to that goal. A real time analyzer can be used to measure the response of the system and room for a pink noise source signal. With pink noise input, the equalizer is then adjusted to get a straight line output of the real time analyzer (RTA). The sound system is then equalized to the room. The steady state response of the room may or may not be perceived by the listeners in the room in the same way as measured by the RTA. The human auditory system has often been found as being sensitive to varying degrees of direct-to-reflected sound energy depending on frequency. The present invention provides an improved method for determining the performance of a sound system and may be used to optimize the system performance.

The following publications and patents reflect the current art in the field.

Patent Application Publication Number 2006000257 to Holloway, et al, discloses a self-adjusted car stereo system is provided. The system includes means for allowing a user to select an ideal listening location. After the ideal listening location has been selected, the system will determine whether sound from each speaker reaches the ideal listening location at the same volume level. If not, the system will automatically adjust the volume of the speakers to ensure that it is indeed so.

U.S. Pat. No. 6,118,880 Kokkosoulis, et al., describes a method and system for dynamically maintaining audio output balance in a stereo audio system. The stereo audio system includes a small hand-held radio frequency remote control and a set of transmitter/receiver control units located at a close proximity to a respective speaker. For example, the stereo audio system may have six transmitter/receiver control units: one at a front-left speaker, one at a front-right speaker, one at a rear-left speaker, one at a rear-right speaker, a center speaker, and a sub-woofer. The stereo audio system is able to make audio balance adjustment for simulating a stereo headphone effect based on the physical position of the listener, throughout the entire listening area.

U.S. Pat. No. 5,778,087, to Dunlavy, discloses a method for stereo loudspeaker placement consisting of applying an acoustic signal having equal amplitude components spread over at least a portion of the audible sound spectrum to a set of stereo loudspeakers to create an acoustic signal, measuring the combined sound level of the acoustic signals at the principal listening position, and adjusting the location of the loudspeakers to ensure that they are acoustically-equidistant from the principal listening position.

U.S. Pat. No. 5,465,302, to Lazzari, et al., discloses a system for the detection and location of acoustic signals which can be used, for example, for the acquisition of voice messages or the like, in environments in which noises, echoes and reverberations are present. The system employs an array of microphones and is based on the Fourier anti-transform calculus of only the information of phases of the normalised cross power spectrum of pairs of signals acquired from the microphones in the array. The system also enables an acoustic message cleared of the undesired components which are due to noises, echoes, etc to be reconstructed.

U.S. Pat. No. 5,386,478, to Plunkett, describes an automatic closed loop adjustment of a stereo sound system optimizing the sound quality at a particular listening location as sensed there by a microphone in a hand-held remote control unit. Such automatic capability is particularly beneficial for asymmetrical locations and may be applied to optimization of perceived channel balance with regard to various parameters such as gain, equalization and time delay, and which are thus inconvenient to set up manually. A hand-held remote control capable of adjusting the stereo system, typically via an infrared link, is additionally equipped with a microphone which senses sound from each stereo loudspeaker at the listening location. The stereo unit is equipped to generate special test signals that are picked up by the microphone and analyzed to provide adjustment information via the remote control link to automatically adjust various parameters in each channel so as to optimize the sound quality as perceived at the particular current listening location where the remote control is located. The remote control's infrared link is utilized as part of a closed loop of an automatic control system in which acoustic information gathered by the microphone is analyzed to control compensatory adjustments.

U.S. Pat. No. 4,764,960, to Aoki, et al., discloses first left and right channel loudspeakers having respective main axes of directivities directed toward left and right listening areas defined in front thereof are provided. In addition, there are provided a second right channel loudspeaker near the first right channel loudspeaker with a main axis of directivity directed toward the left listening area, a second left channel loudspeaker near the first left channel loudspeaker with a main axis of directivity directed toward the right listening area, and signal adjusting means for controlling the relative amplitude and time difference among the signals to be supplied to these loudspeakers.

While all of the foregoing approaches disclose methods for attenuating the volume of a loudspeaker relative to the position of the listener, none address the issue through the analysis of discrete frequencies in the nearfield and farfield, compensating for the difference between the nearfield and farfield levels and treating the compensated data with a SBIC calculation to find the optimal level at each frequency.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

DISCLOSURE OF INVENTION

In the world of audio engineering, there are a number of metrics used to quantify the quality of a sound system. By far the most common of these is to graph the amplitude in relation to the frequency response, which method is commonly referred to as frequency response. In this metric, frequency in Hz is plotted along the horizontal or X-axis of a Cartesian graph, and amplitude in dB is plotted along the vertical or Y-axis. The typical X-axis limits of the graph are 20 Hz and 20 kHz, which represent the extreme ends of the normal range for human hearing, while the Y-axis limits vary depending on the average amplitude of the response being plotted. In general, a straight horizontal line on the frequency response graph is considered ideal, because it indicates that a sound system is producing the same amplitude at every frequency.

Electrical and Electro-Acoustic Measurement Methods: To create a frequency response graph, a sound system must first be measured. The traditional method for measuring the electronics in a sound system is to input a single sine wave of varying frequency from below 20 Hz to above 20 kHz and then measure the amplitude of the sine wave at each frequency. The traditional method for measuring the electro-acoustic frequency response of a sound system (i.e., a measure of frequency response that includes both the electronics of a sound system and the acoustics of the room in which the sound system is located) is to input a broadband stimulus, such as pink noise, and observe the frequency response with a frequency-selective device such as a spectrum analyzer.

Alternative methods of measuring electro-acoustic response are also employed, with the most common being time domain systems, using impulse response with fast Fourier transform, maximum length sequence, and time delay spectrometry.

Differences Between Objective Measurements and Subjective Sound Quality: After electro-acoustic measurements of a sound system have been taken and plotted, it is often observed that the perceived subjective sound quality of the system does not correlate well with the measured objective frequency response. The reasons for this discrepancy are vast and complex, but may be summarily described as follows:

The human ear, the ear pinna, and the head do not respond to sound the same way as do omnidirectional microphones generally used to measure frequency response. A combination of ear and brain processes occurs in the human auditory system. As a result of these processes, the human auditory system is able to separate first-arriving nearfield sound, (i.e., "direct sound," such as sound directly from a loudspeaker) from later-arriving reflections of the same sound (such as reflections from the boundaries of a listening room). The ability of the human auditory system to perform this separation varies with the sound frequency and the delay times of the reflections.

An omnidirectional microphone used in conjunction with a time-invariant measurement system will integrate the nearfield sound from loudspeakers along with the reflected sound from listening room boundaries without discrimination. However, the human auditory system will discriminate between the nearfield sound and the reflections. The difference between the non-discrimination of the measurement system and the discrimination of the human auditory system results in the discrepancies between the objective measurements and subjective sound quality of a sound system. Even measurement systems that operate in the time domain and apply a time window function to the sound from an omnidirectional microphone do not produce objective measurements that correlate to subjective sound quality.

The present invention makes use of recent findings in psycho-acoustics: Psycho-acoustic research conducted in the last decade has shed much light on how the human auditory system discriminates between nearfield and farfield sound. Above 1 kHz, there is almost complete discrimination, and the character of the nearfield sound dominates perceived sound quality. However, below 160 Hz, there is little discrimination, and the direct plus reflected sound, commonly called the farfield or "sound power," dominates perceived sound quality. Between 1 kHz and 160 Hz, there is a gradual shift in the perceived mix between nearfield and farfield sound.

Sliding Band Integration Curve Defined: For an electro-acoustic measurement method to yield objective results that correlate to subjective perception, it must process the proportion of nearfield sound to farfield sound at various frequencies in a manner closely similar to that of the human auditory system. Above the nearfield sound (direct sound) dominance frequency of 1 kHz, the measurement method should consider mainly the nearfield frequency response. Below the farfield (sound power) dominance frequency of 160 Hz, the method should consider mainly the farfield response. Between 1 kHz and 160 Hz, the method should consider an average of the nearfield response and farfield responses with a gradually changing proportion of the two. At frequencies just below 1 kHz, the average should be heavily weighted to the nearfield response. Likewise, at frequencies just above 160 Hz, the average should be heavily weighted to the farfield response. At some frequency between 1 kHz and 160 Hz, the weighting of the two responses should be equal in the average. The shifting ratio of nearfield to farfield power averaging ratios is therefore defined herein as the Sliding Band Integration Curve, or "SBIC." Depending on the volume, configuration, and acoustic character of a listening room, the SBIC may vary somewhat. The farfield and nearfield dominance frequencies may also vary depending on listening room volume and acoustic character.

Measuring the Sliding Band Character of a Sound System: Multi-point measurements must be taken to determine the sliding band character of a sound system. For steady-state frequency domain measurements systems, an initial electro-acoustic broadband response measurement should be taken in the nearfield of the loudspeaker. For a compact High Fidelity loudspeaker in a listening room, the nearfield measurement should be taken at no more than two feet from the loudspeaker. Next, a spatially and temporally averaged broadband response measurement should be taken using multiple locations in the listening room in the region around the listening position. These are defined as farfield measurements. Research shows that four farfield locations are ideal from a practical point of view; five or more locations do not provide a significant improvement in response. Both the nearfield and the farfield measurements are to be at least one-third octave resolution, with the measurement data being stored for later post-processing. Measurement-grade omnidirectional microphones are to be used. The nearfield measurement is so dominated by the direct sound from the loudspeaker that there is no need for a directional microphone.

For time-windowed measurement systems and an initial electro-acoustic broadband response measurement should be taken either in the nearfield of a loudspeaker or with the microphone at the listening position and a time window applied to reject delayed reflections from the listening room boundaries. Next, four additional farfield broadband response measurements with a time window of at least one second should be taken in the listening room in the region around the listening position. Both the nearfield and the farfield measurements are to be at least one-third octave resolution, with the measurement data being stored for later post-processing. Additionally, measurements with various window lengths can be performed and used for later post-processing. For example, a window length that allows the direct sound and 10 ms of sound reflections could be used. Another window length that allows the direct sound and 20 ms of sound reflections could be used. Yet another window length that allows the direct sound and 30 ms of sound reflections could be used. An extension of the multi-window approach is to perform a continuously variable window length that tracks the frequency range according to a relevant relationship between frequency and human sensitivities to time window widths at those frequencies. Measurement-grade omnidirectional microphones are to be used. The nearfield measurement is so dominated by the loudspeaker's direct sound that there is no need for a directional microphone.

Calculating the Sliding Band Character of a Sound System: Once the data from multi-point frequency response measurements has been collected, the sliding band character of a sound system may be calculated. Above 1 kHz, the calculation should consider only the nearfield frequency response. Below 160 Hz, the calculation should consider only the sound power response. Between 1 kHz and 160 Hz, the calculation should employ a shifting ratio between the nearfield response and the farfield response. Calculation of the sliding band character may be performed manually by entering the measurement data into a spreadsheet that averages according to the SBIC, or automatically by a measurement system specifically designed to use the SBIC averaging. The resulting averaged frequency response will be displayed as a single line on a frequency response graph. It can be used to document sound system performance and/or aid in the equalization of the sound system.

As an example, ratios of 80% farfield and 20% nearfield could be applied below 160 Hz. Ratios of 20% farfield and 80% nearfield could be applied above 1 kHz. In the range from 160 Hz to 1 kHz, in the case of measurements with $1/3^{rd}$ octave resolution, 7 steps could be derived. Each step would be $1/7^{th}$ of the span from 20 to 80 Hz, which is 60 Hz. The ratio value would then increment at 20%+(60/7) from the previous step starting at 200 Hz, and until reaching the 800 Hz band. For other measurement resolutions or other measurement centers, the sliding band algorithm would be redefined.

For proper averaging and display results the following steps need to take place. The farfield and nearfield levels must be offset to match each other in the mid-band levels. This will allow proper weighting of the audible results. An average of spectrum levels is conducted on both curves from 500 Hz to 2 kHz. The resulting levels are then compared and an offset value (dB compensation) is assigned to one of the curves to match the other one. Typically, the nearfield would be offset to match the farfield, thereby representing in-room levels to the observer. Once the curves are level matched, the SBIC process can be applied.

The present invention is a method for optimizing the perceived results of a sound system using electroacoustic measurements and a sliding band integration curve (SBIC).

It is therefore an object of the present invention to provide a new and improved system and method for optimizing sound systems.

It is another object of the present invention to provide a new and improved method for adjusting the output of specific frequencies in relation to a point in a listening room.

A further object or feature of the present invention is to introduce a sliding band integration curve to adjust compensated nearfield and farfield sound measurements to produce an optimum response in a sound system in $1/3^{rd}$ octave steps.

Other novel features which are characteristic of the invention, as to organization and method of operation, together with further objects and advantages thereof will be better understood from the following description considered in connection with the accompanying drawings, in which a preferred embodiment of the invention is illustrated by way of example. It is to be expressly understood, however, that the drawings are for illustration only and are not intended to describe the limits of the invention. The various features of novelty which characterize the invention are particularized in the claims annexed to and forming part of this disclosure. The invention resides not in any one of these features taken alone, but rather in the particular combination of all of its structures for the functions specified.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a listing of equalized and non-equalized data from a system measurement;

FIG. 3 is a listing of data derived from FIG. 1 treated with a SBIC calculation;

DRAWING REFERENCE NUMBER LEGEND

Figures 2, 4:
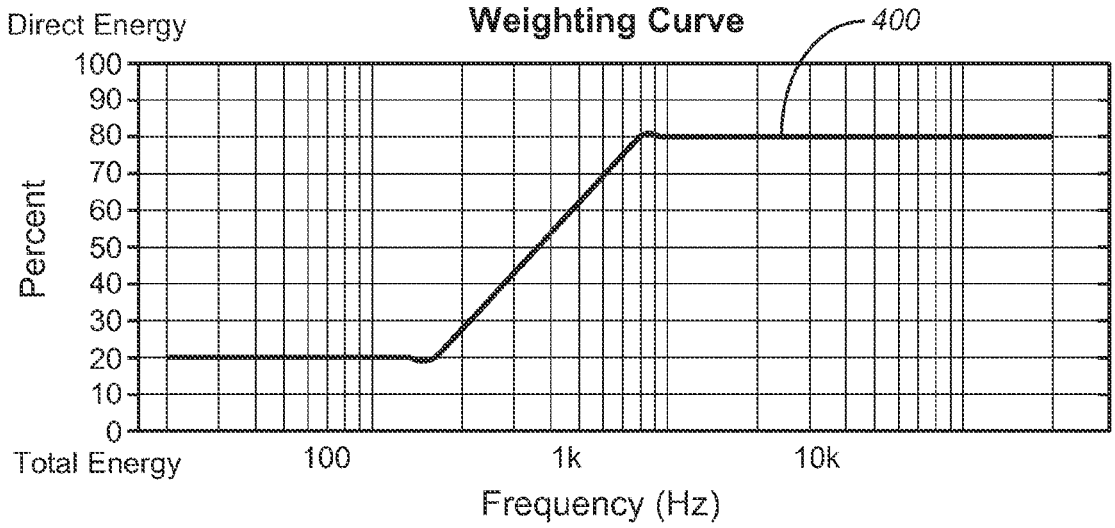
FIG. 2 is a listing of sound frequencies in Hertz (Hz) and the corresponding log values for the frequencies.
FIG. 4 is a graphic representation of the weighting curve used in the SBIC calculation.

100 Data Entry Spreadsheet
110 Frequency column
120 Log of Frequency column
130 Measurement data in decibels (dB) with No Equalization
135 Measurement Data in decibels (dB) with Equalization
140 Farfield column
150 Nearfield column
160 Nearfield Level Compensated column
170 Farfield average
180 Nearfield average
190 dB compensation value
200 Listing of Sound Frequencies in Hertz

210 Frequency Log Values
300 SBIC Calculation Worksheet
310 SBIC Weighting column
320 Combined column
400 SBIC Weighting Curve
500 SBIC Weighted Room Response with No Equalization Graph
510 Level Compensated Nearfield Data Line
520 Farfield Data Line
530 SBIC Weighted Combined Response Line
600 SBIC Weighted Room Response with Equalization Graph
610 SBIC Compensated Nearfield Data Line
620 Farfield Data Line
630 SBIC Weighted Combined Response Line

BEST MODE FOR CARRYING OUT THE INVENTION

Referring to FIGS. 1 through 6, wherein like reference numerals refer to like components in the various views, FIG. 1 is a listing of data for equalized and non-equalized data from a system measurement. Multi-point measurements must be taken to determine the sliding band character of a sound system. For steady-state frequency domain measurements systems, an initial electro-acoustic broadband response measurement should be taken in the nearfield of the loudspeaker. For a compact High Fidelity loudspeaker in a listening room, the nearfield measurement should be taken at no more than two feet from the loudspeaker, though a small amount of latitude may be permissible.

Next, a spatially and temporally averaged broadband response measurement should be taken using multiple locations in the listening room in the region around the listening position. These are the farfield values. Four farfield locations are ideal. The measurements taken are entered into the Data Entry Spreadsheet 100. The data entry spreadsheet 100 is comprised of data columns wherein data from the electro-acoustic broadband response measurements are entered. Data is captured in the following columns. The measured frequency in Hz is entered in the Frequency column 110. The log value of the frequency measurement is computed and displayed in the Log of Frequency column 120. Example measurements appear in the following three column sets. Measurement Data in decibels (dB) with No Equalization 130 and Measurement Data in decibels (dB) with Equalization 135, each have a Farfield column 140 which contains measurement data from the farfield microphones, and a Nearfield column 150 which contains measurement data from a nearfield microphone. Each measurement corresponds to the frequency listed in the Frequency column 110. The measurements in dB from the Farfield column 140 from 500 Hz to 2000 Hz are averaged to give a Farfield average 170. Measurements in dB from the Nearfield column 150 from 500 Hz to 2000 Hz are averaged to give a Nearfield average 180. The Farfield average 170 is subtracted from the Nearfield average 180 to produce a dB compensation value 190. The dB compensation value 190 is then subtracted from each nearfield value and the result is entered into the Nearfield Level-Compensated column 160. The formula for calculation the data in the Nearfield Level Compensated column 160 is (nearfield response—dB compensation value).

FIG. 2 is a columnar Listing of Sound Frequencies in Hertz (Hz) 200 and the corresponding Frequency Log Values 210.

FIG. 3 is a listing of data derived from FIG. 1 treated with a SBIC calculation. Once the data from multi-point frequency response measurements has been collected, the sliding band character of a sound system may be calculated. Above 1 kHz, the calculation should consider only the nearfield frequency response. Below 160 Hz, the calculation should consider only the farfield response. Between 1 kHz and 160 Hz, the calculation should employ a shifting ratio between the nearfield response and the farfield response. Calculation of the sliding band character may be performed manually, by entering the measurement data into a document (e.g., a spreadsheet) that averages according to the SBIC, or automatically by a measurement system specifically designed to store (using, for example, electronic storage media) the measurement data and use the SBIC averaging. The resulting averaged frequency response may be displayed as a single line on a frequency response graph. It can be used to document a sound system's performance and/or aid in the equalization of the sound system. The following fields from FIG. 1 are present in the SBIC Calculation Sheet 300 in the same arrangement as FIG. 1 in order to treat the FIG. 1 measurement data: Frequency column 110; Log of Frequency column 120; Measurement data in decibels (dB) with No Equalization 130 and measurement data in decibels (dB) with Equalization 135; Farfield column 140; the Nearfield Level Compensated column 160.

In addition, a Weighting column 310 is inserted into the SBIC Calculation Worksheet 300. In the Weighting column 310, ratios of 80% of the farfield and 20% of the nearfield are applied below 160 Hz. Ratios of 20% farfield and 80% nearfield are applied above 1 kHz. In the range from 160 Hz to 1 kHz, in the case of measurements with $\frac{1}{3}^{rd}$ octave resolution, 7 steps are derived to define the SBIC weighting curve. Each step is $\frac{1}{7}^{th}$ of the span from 20 to 80 Hz, which is 60 Hz. The ratio value then increments at 20%+(60/7) from the previous step starting at 200 Hz, and until reaching the 800 Hz band. For other measurement resolutions or other measurement centers, the sliding band algorithm can be redefined. The Combined column 320 contains calculations derived from the value in the Weighting column 310 assigned to a frequency and the value in the Farfield column 140 and the Nearfield Level Compensated column 160. The formula is: Combined Value=(farfield value*(1−weighting value %))+(nearfield level compensated value*weighting value %). For example, for the 200 Hz measurements in the example SBIC Calculation Worksheet 300, the formula would be: (54.86719*(1−0.2857143))+(59.34152*0.2857143)= 56.145568.

A graphic representation of the Weighting Curve 400, is represented in FIG. 4. The weighting curve 400 is plotted with the Frequency (Hz) plotted on the X axis in a log scale and the Percent direct energy plotted on the Y axis in percent.

Figure 5:
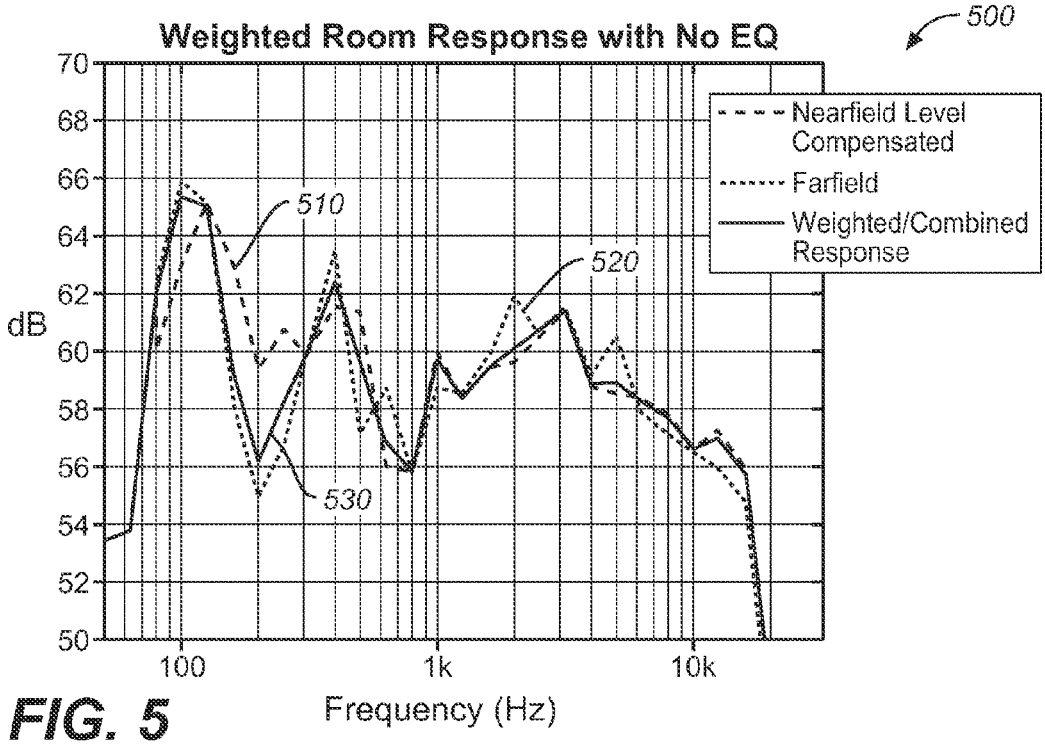
FIG. 5 is a graphic representation of the SBIC weighted room response with no equalization.
Figure 6:
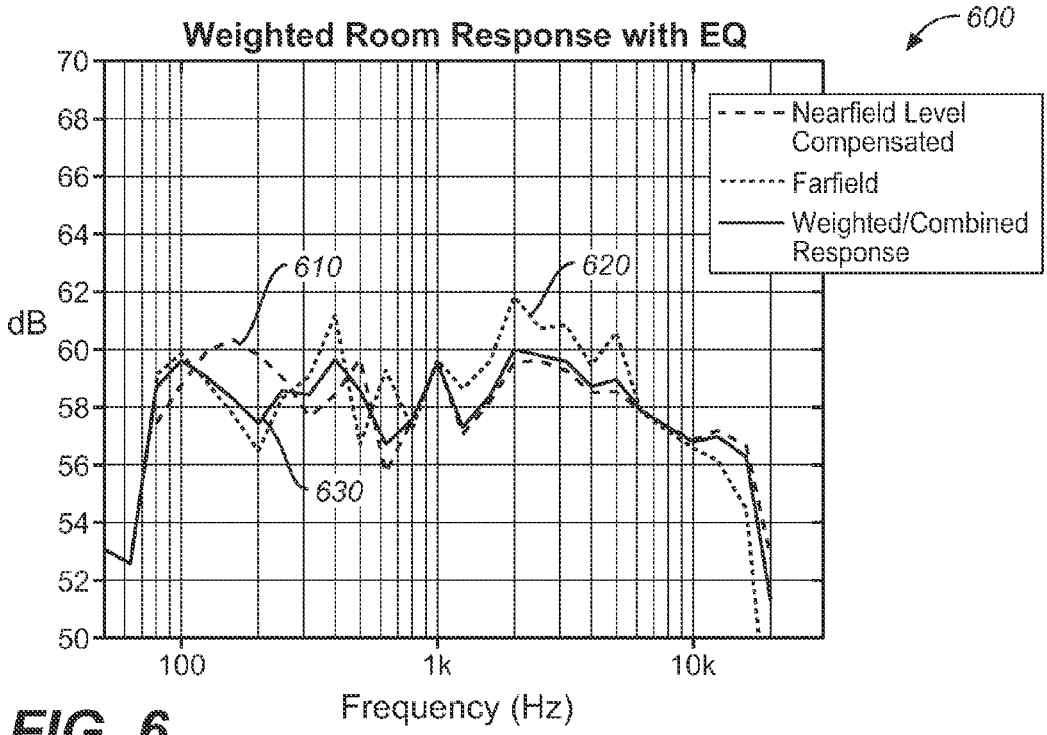
FIG. 6 is a graphic representation of the SBIC weighted room response with equalization

FIGS. 5 and 6 are the SBIC Weighted Room Response with No Equalization Graph 500 and the SBIC Weighted Room Response with Equalization Graph 600, respectively.

The data for the SBIC Weighted Room Response with No Equalization Graph 500 is taken from the Measurement data in decibels (dB) with No Equalization 130. The Nearfield Level Compensated Data Line 510 comprised of the data in the Nearfield Level Compensated column 160, Farfield Data Line 520 comprised of the data in the Farfield column 140, and the SBIC Weighted Combined Response Line 530, comprised of the data in the Combined column 320 are plotted on the SBIC Weighted Room Response with No Equalization Graph 500.

The data for the SBIC Weighted Room Response with Equalization Graph 600 is taken from the Measurement data in decibels (dB) with Equalization 135. The Nearfield Level Compensated Data Line 610 comprised of the data in the Nearfield Level Compensated column 160, Farfield Data Line 620 comprised of the data in the Farfield column 140, and the SBIC Weighted Combined Response Line 630, comprised of the data in the Combined column 320 are plotted on the SBIC Weighted Room Response with Equalization Graph 600. Frequency (Hz) is plotted on the X axis in a log scale, and the decibels (dB) are plotted on the Y axis for both graphs. The SBIC Weighted Combined Response Line 530 is utilized to determine the perceived the error in a sound system being tested. The system is then to be equalized until its SBIC weighted response produces a line that is sufficiently flat to be considered linear. SBIC Weighted Combined Response line 630 documents the corrected and optimized response of the system.

The foregoing disclosure is sufficient to enable those with skill in the relevant art to practice the invention without undue experimentation. The disclosure further provides the best mode of practicing the invention now contemplated by the inventor.

While the particular optimization of sound systems using electroacoustic measurements and a sliding band integration curve (SBIC) method herein shown and disclosed in detail is fully capable of attaining the objects and providing the advantages stated herein, it is to be understood that it is merely illustrative of the presently preferred embodiment of the invention and that no limitations are intended concerning the detail of construction or design shown other than as defined in the appended claims. Accordingly, the proper scope of the present invention should be determined only by the broadest interpretation of the appended claims so as to encompass obvious modifications as well as all relationships equivalent to those illustrated in the drawings and described in the specification.

What is claimed as invention is:

1. A method for using microphones and a signal measuring system to measure and optimize a sound system in a listening room, said method comprising the steps of:

(a) measuring the direct sound electro-acoustic response ("direct sound response") of a loudspeaker;

(b) measuring the sound power electro-acoustic response ("sound power response") of a loudspeaker;

(c) determining the average direct sound level;

(d) determining the average sound power level;

(e) determining a compensation value by calculating the difference between the average direct sound level and the average sound power level;

(f) calculating a compensated direct sound response by subtracting the compensation value from the measured direct sound;

(g) determining a weighted sound power response and weighted compensated direct sound response by weighting the sound power and the compensated direct sound response over a range of frequencies following a set of weighting values that represent auditory sensitivities to direct sound and sound power sounds;

(h) combining the weighted sound power response and the weighted compensated direct sound response additively to calculate a weighted combined response; and (i) visually representing the weighted combined response.

2. The method of claim 1, wherein the direct sound is measured in the nearfield and the sound power is measured in the farfield.

3. The method of claim 2, wherein the signal measurement system is a real time analyzer.

4. The method of claim 1, wherein the signal measurement system is a time based analyzer.

5. The method of claim 4, wherein steps (a) and (b) entail placing a single microphone proximate a listening position to obtain the direct sound response, placing a plurality of microphones in multiple locations in the listening room in the region around the median of the listening room area to obtain a sound power response, and connecting the microphones to the signal measurement system.

6. The method of claim 5, wherein step (a) entails time windowing of the signal from the microphone proximate the listening position so as to remove any room sound reflections from the measurement and step (b) entails a time window that includes a substantial number of room sound reflections, and means to determine the average sound response of the measurements from the plurality of microphones.

7. The method of claim 6, wherein the time windowing of the signal from the microphone proximate the listening position is wide enough to allow direct sound and some reflections.

8. The method of claim 7, wherein a plurality of time windowing processes are applied to the signal from the microphone proximate the listening position.

9. The method of claim 7, wherein a continuously variable time windowing process is applied to the signal from the microphone proximate the listening position.

10. The method of claim 1, further including the steps of transmitting a broadband acoustic signal through the sound system to be measured, sending the transmitted signal to the loudspeaker(s), and measuring the direct sound response and the sound power response discretely and simultaneously on the signal measurement system.

11. The method of claim 1, further including the step of exporting the direct sound response and the sound power response data for data reduction.

12. The method of claim 1, wherein in steps (a) and (b) the direction sound response and the sound power response are measured in ⅓ octave steps between 20 Hz and 20000 Hz.

13. The method of claim 1, wherein the compensation value is determined from the values in the region from about 500 Hz to 2000 Hz.

14. The method of claim 1, wherein in step (g) the sliding band integration curve is characterized by ratios of 80% farfield response and 20% nearfield response applied below 160 Hz, ratios of 20% farfield response and 80% nearfield response applied above 1000 Hz, and in the range from 160 Hz to 1000 Hz, in the case of measurements with $\frac{1}{3}^{rd}$ octave resolution, seven steps are derived, each step $\frac{1}{7}^{th}$ of the span from 20 to 80 Hz, which is 60 Hz, the ratio value then incrementing at 20%+(60/7) from the previous step starting at 200 Hz, and continuing until reaching the 800 Hz band.

15. The method of claim 14, wherein in step (g) the sliding band integration curve is characterized by a plurality of ratios of the responses.

16. The method of claim 15, wherein in step (g) the sliding band integration curve is characterized by a continuously variable time window of the response.

17. A method of measuring and optimizing sound system performance for loudspeakers in a given listening room, comprising the steps of:

(a) taking at least one electro-acoustic broadband sound measurement in the nearfield of the loudspeakers;

(b) taking a spatially and temporally averaged broadband farfield response measurement from multiple locations in the listening room in the region around the listening position;

(c) collecting and using data storage means for storing the measurement data from steps (a) and (b); and (d) calculating the weighted sound power response by weighting the sound power and the compensated direct sound response over a range of frequencies following a set of weighting values that represent auditory sensitivities to direct sound and sound power sounds.

18. The method of claim 17, wherein when effecting step (d), calculating the weighting for frequencies above 1 kHz considers mainly the nearfield frequency response, when calculating the weighting for frequencies below 160 Hz the calculation considers mainly the farfield response, and when calculating the weighting for frequencies between 1 kHz and 160 Hz, the calculation employs a shifting ratio between the nearfield response and the farfield response.

19. The method of claim 17, wherein step (d) is performed manually by entering the measurement data into a spreadsheet that averages according to the weighting values.

20. The method of claim 17, wherein step (d) is performed automatically by a measurement system specifically designed to use the weighting values.

21. The method of claim 17, further including the step of providing a weighting value calculation worksheet for the calculations made in step (d).

22. The method of claim 17, wherein the weighting value calculation worksheet includes:

a Frequency column for entering the measured frequency in Hz;

a Log of Frequency column for entering the log value of the frequency measurement;

a Farfield column for entering measurement data from a farfield microphone in decibels (dB) with no equalization;

a Farfield column for entering measurement data from a farfield microphone in decibels (dB) with equalization;

a Nearfield Level Compensated column for entering the result of subtracting the dB compensation value from each measured nearfield value entered in the data entry spreadsheet, using the formula ((Near Field response value (no equalization)−dB Compensation value=Near Field Level Compensated−no equalization)); and a Nearfield Level Compensated column for entering the result of subtracting the dB compensation value from each measured nearfield value entered in the data entry spreadsheet, using the formula ((Near Field response value (with equalization)−dB Compensation value=Near Field Level Compensated−with equalization)).

23. The method of claim 17, further including the step of inserting a weighting column into the weighting value calculation worksheet, wherein ratios of 80% farfield response and 20% nearfield response are applied below 160 Hz, ratios of 20% farfield response and 80% nearfield response are applied above 1 kHz, and in the range from 160 Hz to 1 kHz, in the case of measurements with $1/3^{rd}$ octave resolution, seven steps are derived to define the weighting value weighting curve, each step being $1/7^{th}$ of the span from 20 to 80 Hz, or 60 Hz, such that the ratio value increments at 20%+(60/7) from the previous step starting at 200 Hz, until the 800 Hz band is reached.

24. The method of claim 23, further including the step of inserting a Combined column in the weighting value SBIC calculation worksheet, which contains calculations derived from the value in the Weighting column assigned to a frequency, the value in the Farfield column, and the value in the Nearfield Level Compensated column, wherein the formula is: Combined value=(((farfield value*(1−weighting value %))+(nearfield level compensated value*weighting value %)).

* * * * *